US007380901B2

(12) United States Patent
Shioya

(10) Patent No.: US 7,380,901 B2
(45) Date of Patent: Jun. 3, 2008

(54) RECORDING METHOD AND RECORDING APPARATUS CAPABLE OF REDUCING STREAKS AND UNEVENNESS IN IMAGE DENSITY

(75) Inventor: Makoto Shioya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/533,950

(22) Filed: Sep. 21, 2006

(65) Prior Publication Data

US 2007/0013730 A1 Jan. 18, 2007

Related U.S. Application Data

(62) Division of application No. 10/714,640, filed on Nov. 18, 2003, now Pat. No. 7,147,300.

(30) Foreign Application Priority Data

Nov. 22, 2002 (JP) ..... 2002-339578
Oct. 30, 2003 (JP) ..... 2003-370643

(51) Int. Cl.
*B41J 29/393* (2006.01)

(52) U.S. Cl. ..... 347/19; 347/41; 347/15

(58) Field of Classification Search ..... 347/15, 347/19, 41
See application file for complete search history.

(56) References Cited

U.S. PATENT DOCUMENTS

| | | | | |
|---|---|---|---|---|
| 4,999,646 | A | 3/1991 | Trask | 346/11 |
| 5,340,479 | A | 8/1994 | Szczepanski et al. | 348/208 |
| 5,384,587 | A | 1/1995 | Takagi et al. | 347/41 |
| 5,650,803 | A | 7/1997 | Tamura et al. | 347/15 |
| 5,933,162 | A | 8/1999 | Shioya | 347/40 |
| 6,217,142 | B1 | 4/2001 | Shioya et al. | 347/15 |
| 6,471,322 | B2 | 10/2002 | Kanda et al. | 347/15 |
| 6,513,906 | B1 | 2/2003 | Tanaka et al. | 347/41 |
| 6,547,361 | B1 | 4/2003 | Suzuki et al. | 347/19 |
| 6,863,371 | B2 * | 3/2005 | Suzuki et al. | 347/41 |
| 2001/0003458 | A1 * | 6/2001 | Shioya | 347/19 |
| 2002/0008731 | A1 * | 1/2002 | Matsumoto et al. | 347/42 |
| 2002/0024558 | A1 | 2/2002 | Fujita et al. | 347/43 |
| 2002/0067393 | A1 | 6/2002 | Kanda et al. | 347/41 |
| 2003/0090537 | A1 | 5/2003 | Tanaka et al. | 347/41 |

FOREIGN PATENT DOCUMENTS

| | | |
|---|---|---|
| JP | 57-41965 | 3/1982 |
| JP | 60-107975 | 6/1985 |
| JP | 3-231861 | 10/1991 |
| JP | 2-708439 | 10/1997 |
| JP | 2-711011 | 10/1997 |

* cited by examiner

*Primary Examiner*—Lamson D. Nguyen
(74) *Attorney, Agent, or Firm*—Fitzpatrick, Cella, Harper & Scinto

(57) ABSTRACT

A recording method for use in a recording system for completing an image by multiple scans of a recording head includes the steps of reading an image recorded by a predetermined number of scans among the multiple scans of the recording head except at least the last scan, and correcting, based on a result of reading the image in the reading step, data for an image to be recorded by one or more scans subsequent to the predetermined number of scans. An image is correctively recorded by performing one or more scans subsequent to the predetermined number of scans in accordance with the corrected data.

11 Claims, 9 Drawing Sheets

RECORDING METHOD AND RECORDING APPARATUS CAPABLE OF REDUCING STREAKS AND UNEVENNESS IN IMAGE DENSITY

This is a division of application Ser. No. 10/714,640, filed on Nov. 18, 2003.

BACKGROUND OF THE INVENTION

1. Field of the Invention

The present invention relates to an ink jet recording method and apparatus. More particularly, the present invention relates to an ink jet recording method and apparatus capable of reducing streaks and unevenness in recording density and forming an image with good quality.

2. Description of the Related Art

An ink jet (IJ) recording method is widely used because of advantageous features, i.e., a high speed, high image quality, and a low running cost. Recently, with the development of information infrastructures such as computer hardware/software and networks, a higher speed and higher image quality have been demanded.

In ink jet recording techniques, one problem to be overcome for achieving higher image quality is a variation in ink droplets discharged from an ink jet recording head. Such a variation occurs, for example, in the amount of ink discharged and the discharge direction of ink droplets. It is also known that the variation in ink discharge causes the following problems.

(1) For a plurality of discharge ports of the recording head, if there is a variation in the discharge direction of ink droplets for each of the discharge ports, the positions of dots formed on the recording paper are offset and, hence, streaks appear in a recorded image.

(2) If there is a variation in the amount of discharged ink for each of the discharge ports, the sizes and densities of dots formed on the recording paper are varied and, hence, density unevenness appears in a recorded image.

(3) If there are variations in the direction and the amount of ink discharged through one discharge port, the positions, sizes, and densities of dots formed in the main scanning direction on the recording paper are varied; thus, a line in the main scanning direction may not be uniform, or a recorded image may have a rough feel when viewed. This problem is more likely to occur when using a bubble jet method, in which ink is discharged by utilizing thermal energy, instead of the other various discharge methods used in ink jet recording techniques.

As one method for avoiding those problems, the recording head is manufactured at very high accuracy to minimize variations in the direction and the amount of discharged ink for each of the discharge ports. However, such a method gives rise to problems that the production cost is increased and the production yield is reduced.

Also, as a method for eliminating density unevenness through software, Japanese Patent Laid-Open No. 57-41965, Japanese Patent Publication No. 2708439, Japanese Patent Publication No. 2711011, etc. disclose a process of changing the number of driven ink droplets so as to cancel variations in the amount of discharged ink among the discharge ports. The inventions disclosed in those related publications are concerned with the technique of recording a test pattern by using a recording head beforehand, reading the density of the recorded test pattern, and correcting the density unevenness. For example, information regarding characteristics, such as the ink discharge amount of the recording head, is obtained based on variations in the read density unevenness, and the obtained information is utilized in image processing executed when an image is actually recorded. The number of driven ink droplets, the amount of discharged ink, etc. are thereby adjusted so as to suppress the occurrence of streaks and density unevenness. The disclosed method is to execute a correction process by utilizing information of the density unevenness that is obtained from the result of recording the test pattern beforehand, and it is confirmed as being an effective manner for reducing the density unevenness.

However, the disclosed method has a problem as follows. When variations in the amount of discharged ink among the discharge ports change with time, the correction process is executed whenever the change occurs, by repeating the steps of recording the test pattern and reading the recorded test pattern. Accordingly, a plurality of processing steps must be carried out whenever the correction process is executed, and maintainability of the device deteriorates. In other words, the correction process requires not only time and labor for recording the test pattern, but also ink and recording paper for executing the process. Furthermore, when a user has recorded an image without noticing a reduction in image quality caused by deterioration with time, the ink, the recording paper, and the time required for the recording are wasted. In addition, the disclosed method is not effective when the direction and the amount of ink discharged through one discharge port vary for each of the discharge ports.

To overcome the problems mentioned above, Japanese Patent Laid-Open Nos. 60-107975 and 3-231861, for example, disclose a recording method of forming one line in the main scanning direction by ink droplets discharged through a plurality of discharge ports to reduce variations in the direction and the amount of discharged ink among the discharge ports so that streaks and density unevenness are less recognizable.

The disclosed method will be described below with reference to FIG. 1. In a preceding main scan of a recording head ("main scan" is referred to simply as "scan" hereinafter), pixels not adjacent to each other in both horizontal and vertical directions (i.e., the main scan direction of the head and a sub-scan direction of paper feed) are recorded. Then, recording paper is fed in the sub-scan direction through a distance corresponding to a half of the length of a discharge port row. In a subsequent scan, the remaining pixels which have not been recorded in the preceding scan are recorded.

In the example of FIG. 1, pixel data (image data), denoted by 1*a*, forming all pixels of each line is recorded by a method as represented in 1*b*. More specifically, all dots of each line are divided into a group of dots recorded in a preceding scan and another group of dots recorded in a subsequent scan. Then, the dots of the same line are recorded by using different recording elements (nozzles) in the preceding scan and the subsequent scan. With this method, taking the pixel data (image data) denoted by 1*a* in FIG. 1 as an example, each dot row (line) 1*c* in the main scanning direction is recorded by two different sets of discharge ports, whereby variations in the discharge direction are averaged and therefore streaks become less recognizable. Further, with the method shown in FIG. 1, assuming that a variation in the amount of discharged ink among the discharge ports occurs in normal distribution of standard deviations, a variation in the amount of discharged ink among the lines is reduced to $\sigma/\sqrt{2}$. Thus, because a variation in the amount of discharged ink among the lines is recognized as a variation in density, an image with less density unevenness can be obtained.

However, the method shown in FIG. 1 has a problem as follows. When recording a particular half-tone image (in which pixels are not all formed), for example, as denoted by 2*a* in FIG. 2, each dot row in the main scanning direction is formed by ink droplets discharged through the same sets of discharge ports according to that method. Therefore, the effect of reducing streaks and density unevenness is not obtained in such a case.

Further, since the method shown in FIG. 1 is intended to reduce streaks and density unevenness based on statistics and probability approaches by employing ink droplets from plural sets of discharge ports to average the directions and the amounts of discharged ink, it is not ensured that streaks and density unevenness are always reduced. For example, if the discharge directions of ink droplets from two discharge ports forming the same line are both curved in the same direction, or if the amounts of ink discharged through the two discharge ports are both reduced, the effect of reducing streaks and density unevenness cannot be obtained. In addition, the method shown in FIG. 1 is not sufficiently effective when the direction and the amount of ink discharged through one discharge port vary for each of the discharge ports.

Another recording method for making streaks and density unevenness less recognizable is disclosed in U.S. Pat. No. 5,430,479 filed by the inventors of this application. This method is intended to reduce streaks and density unevenness in a multi-value image by employing a multiplicity of ink droplets discharged through a multiplicity of discharge ports to form one pixel.

While the method disclosed in the above-cited Japanese Patent Laid-Open Nos. 60-107975 and 3-231861 performs binary recording, the method disclosed in U.S. Pat. No. 5,430,479 performs multi-value recording. The latter method is superior in that, even when recording a particular half-tone image, streaks and density unevenness are less apt to occur.

Even with the method disclosed in the above-cited U.S. Pat. No. 5,430,479, however, since streaks and density unevenness are reduced based on statistics and probability approaches by employing ink droplets from a plurality of discharge ports to average the directions and the amounts of discharged ink, it is also not ensured that streaks and density unevenness are always reduced.

In addition, the method disclosed in the above-cited U.S. Pat. No. 5,430,479 is also not sufficiently effective when the direction and the amount of ink discharged through one discharge port vary for each of the discharge ports.

A method for solving the above-mentioned problems is disclosed in U.S. Pat. No. 6,547,361. This method comprises the steps of reading a recorded image, comparing the read recorded image with the image information used to record it, determining positions of recording failures, and recoding again the same image while correcting the recording failures in a subsequent scan. As a result, streaks and density unevenness can reliably be reduced for any image. Further, even when the direction and the amount of ink discharged through one discharge port vary for each of the discharge ports, it is possible to reliably reduce streaks and density unevenness.

Regarding U.S. Pat. No. 6,547,361, this patent discloses the method for locating the positions of recording failures and performing correction recording in a subsequent scan, but does not sufficiently disclose the process of creating correction data that is effective to satisfactorily reduce streaks and density unevenness in addition correcting the recording failures.

SUMMARY OF THE INVENTION

In view of the problems set forth above, it is an object of the present invention to provide an ink jet recording method and apparatus realizing a process that is able to eliminate image defects, including density unevenness described above, in a subsequent scan for recording.

The present invention has the feature that, by reading a density of an image, not yet completed, in a preceding scan of recording and reflecting the result of the reading in a subsequent scan of recording, streaks and density unevenness that occurred in the preceding scan of recording are reduced in the subsequent scan of recording. More specifically, based on the result of the reading, recording data for use in the subsequent scan of recording are corrected so as to reduce streaks and density unevenness.

To achieve the above object, the present invention provides a recording method for use in a recording system for completing an image by multiple scans of a recording head, the method comprising the steps of reading an image recorded by a predetermined number of scans among the multiple scans of the recording head except at least the last scan; correcting, based on a result of reading the image in the reading step, data for an image to be recorded by one or more scans subsequent to the predetermined number of scans; and correctively recording an image by performing one or more scans subsequent to the predetermined number of scans in accordance with the corrected data.

Also, the present invention provides a recording apparatus for scanning a recording head relative to a recording medium to record an image, the apparatus comprising a recording control unit for scanning the recording head multiple times relative to the recording medium to complete the image; a reading unit for reading an image recorded on the recording medium; and a correcting unit for reading an image recorded by a predetermined number of sans among the multiple relative scans of the recording head except at least the last scan by the reading unit and correcting, based on a result of reading the image, data for an image to be recorded by one or more scans subsequent to the predetermined number of scans.

Further, the present invention provides a recording apparatus including a recording head having a recording width corresponding to a recording area of a recording medium in a width direction thereof, the recording head recording an image while the recording medium is fed, the apparatus comprising a first recording head and a second recording head disposed in spaced relation in a feed direction of the recording medium; a reading unit disposed at a position downstream of the first recording head and upstream of the second recording head in the feed direction of the recording medium to be able to read an image recorded by the first recording head; and a correcting unit for correcting data used for recording made by the second recording head based on a result of reading the image, which has been recorded by the first recording head, by the reading unit.

Further objects, features and advantages of the present invention will become apparent from the following description of the preferred embodiments with reference to the attached drawings.

DESCRIPTION OF THE PREFERRED EMBODIMENTS

An embodiment of the present invention will be described in detail below.

Figure 1:
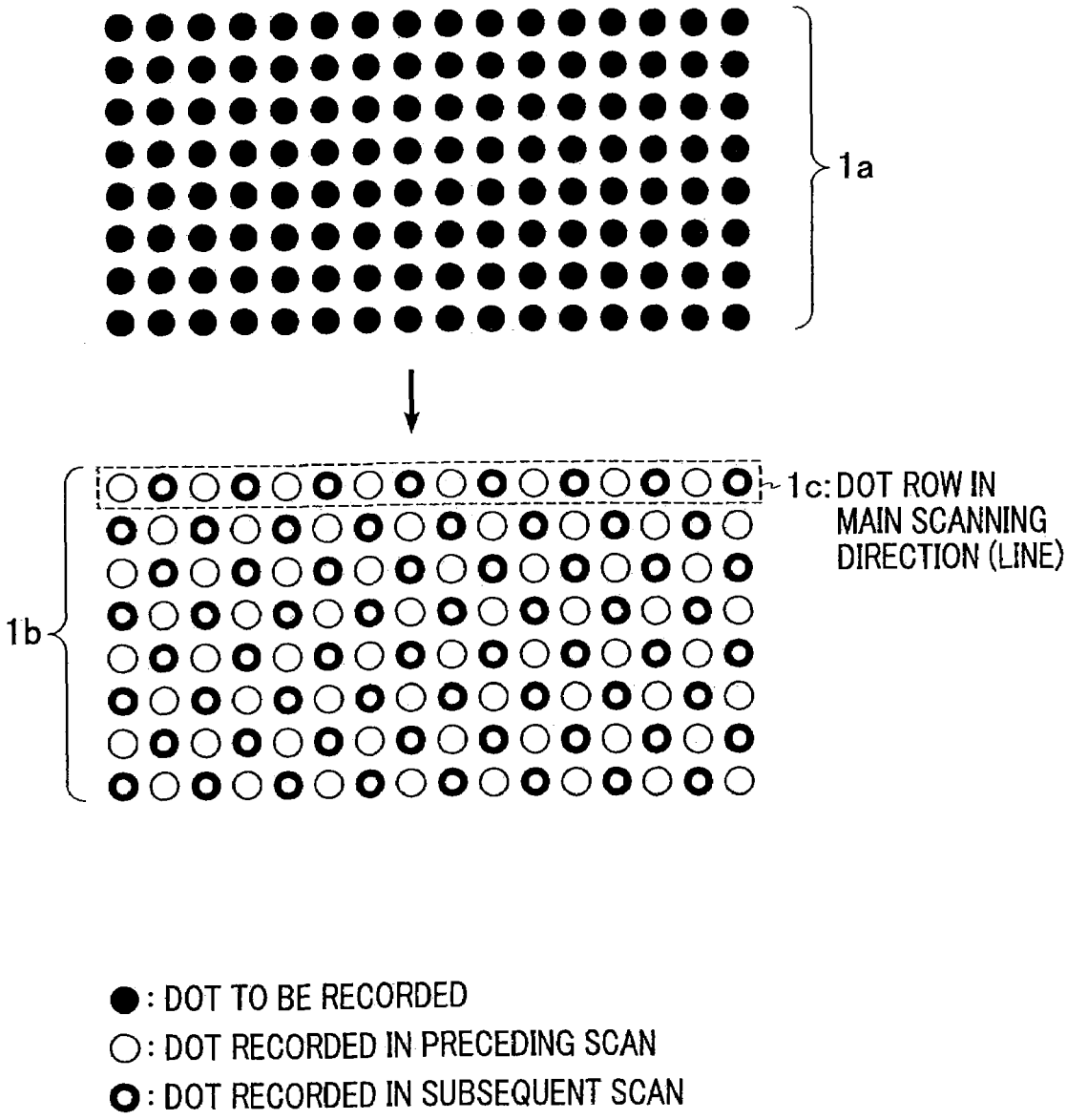
FIG. 1 is an illustration for explaining a known recording method for completing an image by plural scans.
Figure 2:
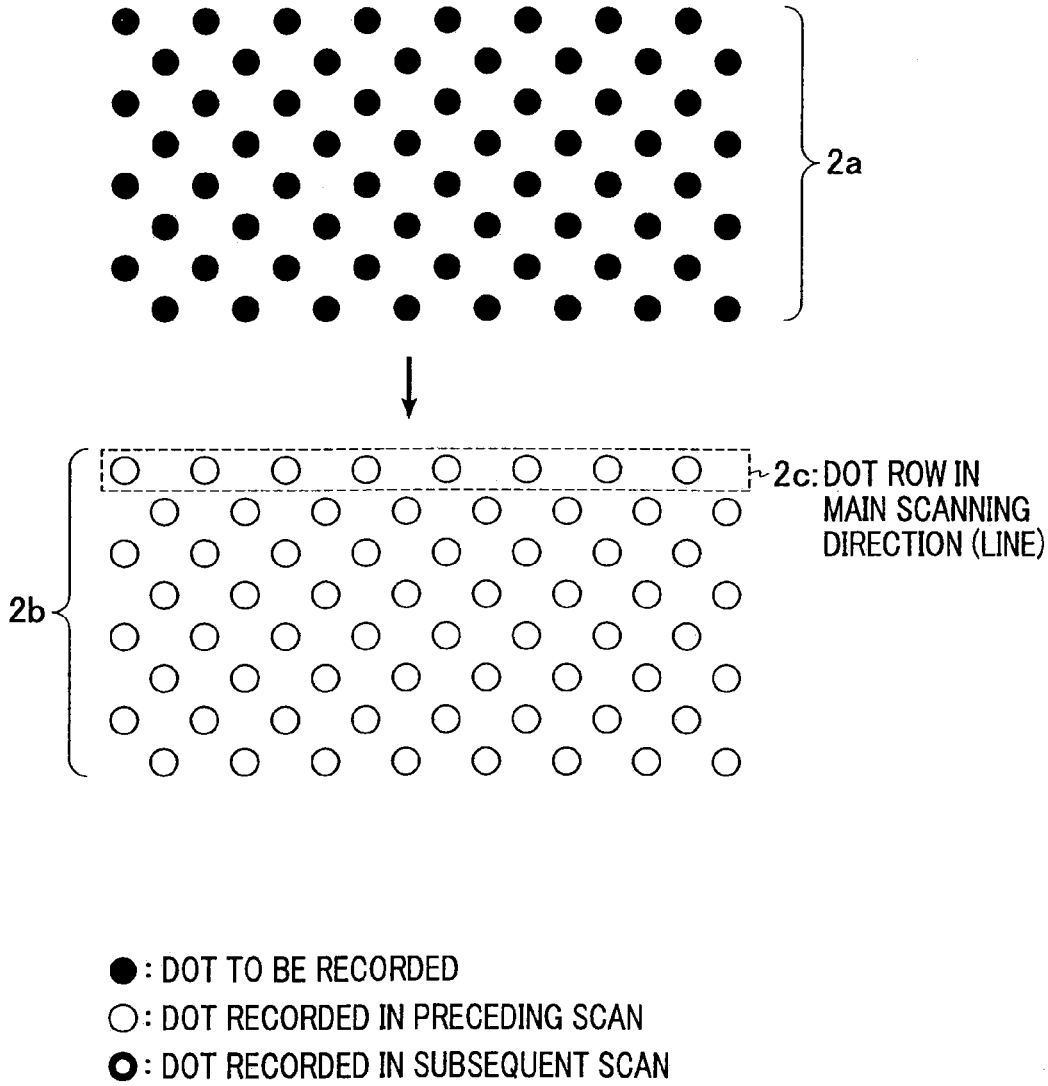
FIG. 2 is an illustration for explaining a recording result obtained when a particular pattern is recorded by the recording method shown in FIG. 1.
Figure 3:
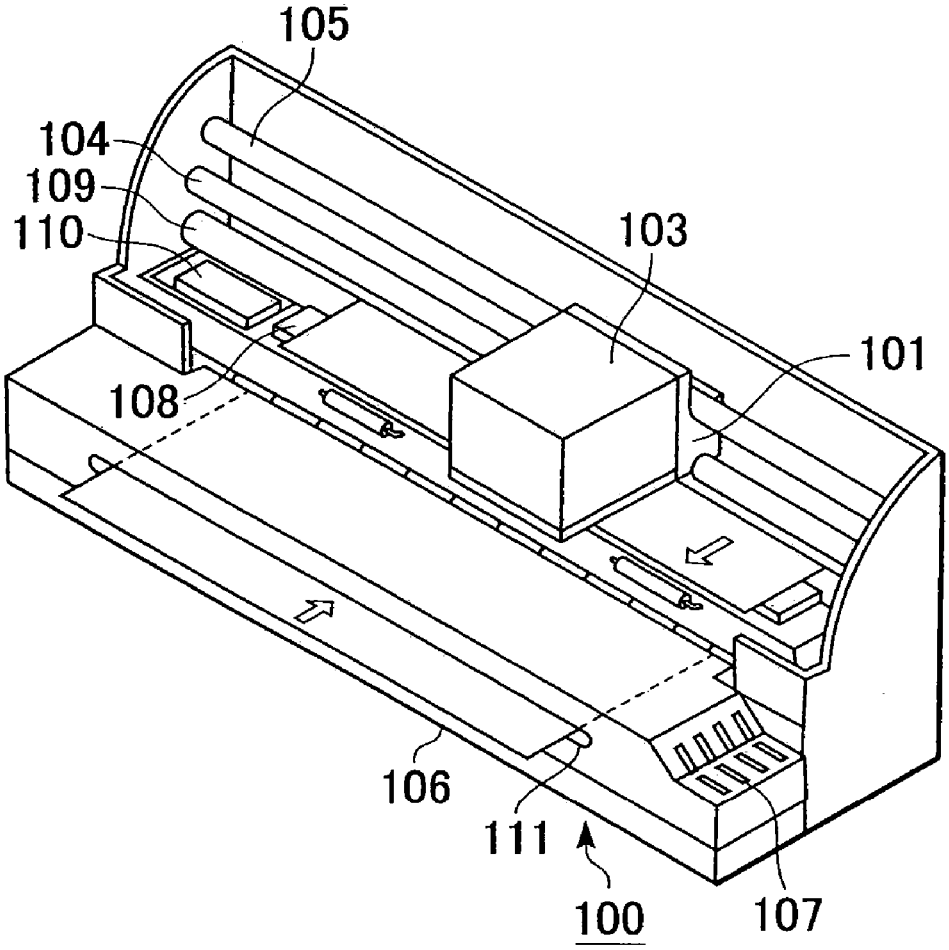
FIG. 3 is a schematic perspective view of an ink jet printer to which the present invention can be applied.

FIG. 3 is a schematic perspective view of an ink jet printer according to one embodiment of the present invention.

In an ink jet printer 100, a carriage 101 is slidably fitted over two guide shafts 104 and 105 extending parallel to each other. The carriage 101 can be moved along the guide shafts 104 and 105 by a drive motor (not shown) through a driving force transmission mechanism (also not shown), such as a belt, for transmitting driving forces generated by the drive motor. The carriage 101 mounts thereon an ink jet unit 103 including an ink jet head, a device for reading a state of recording made by the head, and an ink tank containing ink used by the head. Those components mounted on the carriage 101 will be described in more detail later with reference to FIG. 4.

Stated another way, the ink jet unit 103 comprises heads for discharging respective inks, a device for reading a state of recording made by the heads, and tanks as containers for containing the inks supplied to the corresponding heads. More specifically, four heads for discharging respectively inks in four colors, i.e., black (Bk), cyan (C), magenta (M) and yellow (Y), an optical device made up of a light emitting section and a reading section for reading the state of recording made by the heads, and ink tanks corresponding to the respective heads are mounted as the ink jet unit 103 on the carriage 101.

A sheet of paper 106, as a print medium, is fed into the ink jet printer through an insertion port 111 provided at a front end of the printer. Finally, the paper 106 is advanced by a feed roller 109 to a position under a region in which the carriage 101 moves, after its feed direction has been reversed. The carriage 101 is moved across the paper 106. During the movement of the carriage 101, the inks are discharged from the head mounted on the carriage 101, whereby a print (image) is recorded in a print area on the paper 106 supported on a platen 108.

At a left end of the region in which the carriage 101 is movable, a recovering system unit 110 is disposed to be able to face respective lower ends of the heads mounted on the carriage 101. With such an arrangement, the recovering system unit 110 can perform an operation of capping discharge ports of each of the heads, an operation of sucking the inks from the discharge ports of each head, and so on.

Figure 4:
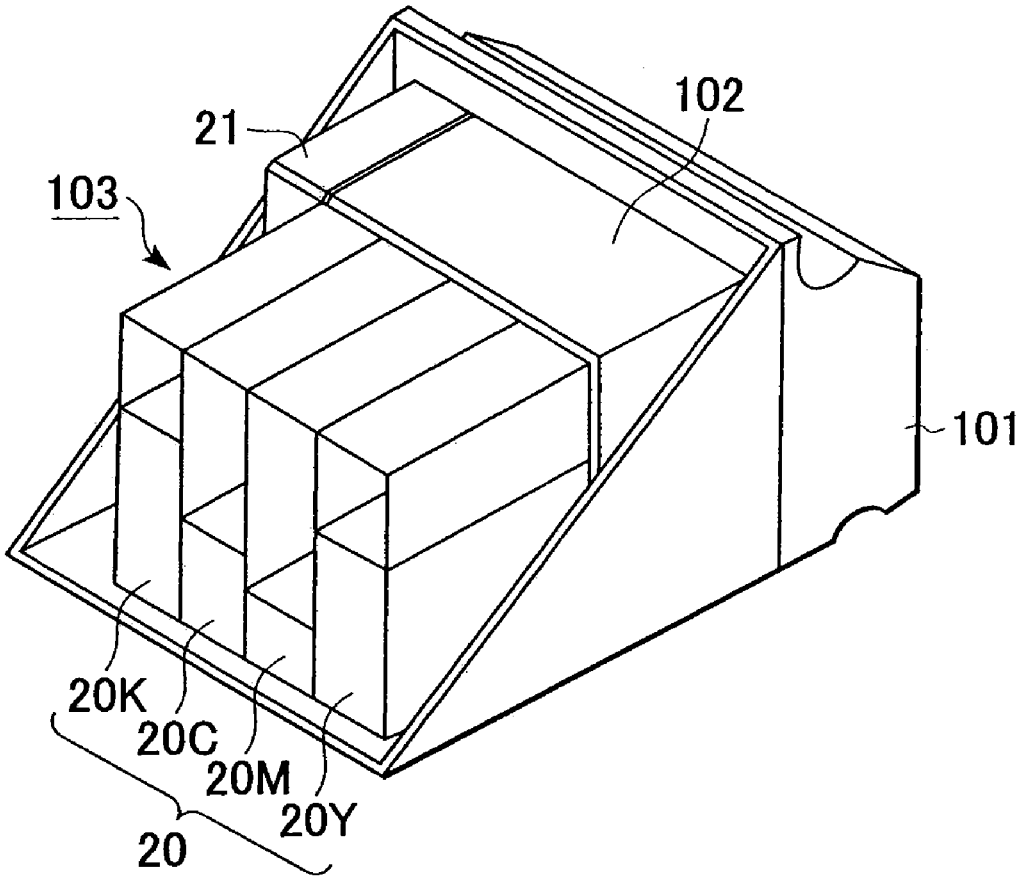
FIG. 4 is a schematic perspective view of an ink jet unit which can be applied to the ink jet printer shown in FIG. 3.

FIG. 4 is a schematic perspective view of the ink jet unit 103 described above with reference to FIG. 3. The ink jet unit 103 comprises, as mentioned above, the four heads, the tanks for inks in four colors, i.e., black (Bk), cyan (C), magenta (M) and yellow (Y), and the optical device 21 made up of the light emitting section and the reading section for reading the state of recording.

More specifically, the carriage 101 mounts thereon a head case 102 to which the heads are each detachably attached, four ink tanks, i.e., a Bk tank 20K, a C tank 20C, an M tank 20M and a Y tank 20Y, and the optical device 21 for reading. Four heads 30K, 30C, 30M and 30Y (not shown in FIG. 4) for discharging the inks of Bk, C, M and Y, respectively, are mounted on the head case 102. The four tanks are connected to the corresponding heads through joints so that the inks are supplied to the respective heads.

Figure 5:
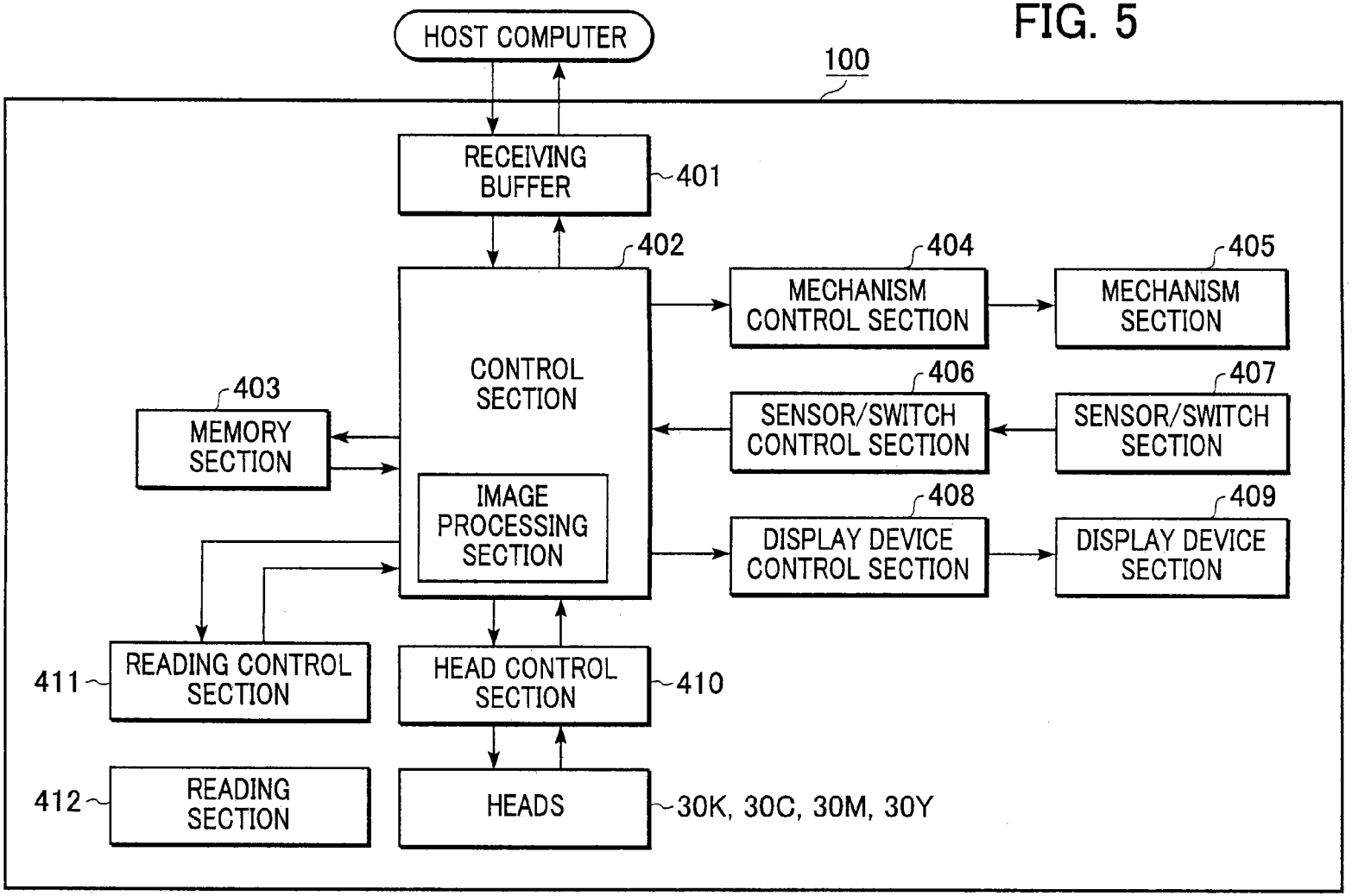
FIG. 5 is a block diagram showing a control configuration of the ink jet printer shown in FIG. 3.

FIG. 5 is a block diagram showing a control configuration of the ink jet printer to which the present invention can be applied.

Data of characters and images to be printed (referred to as "image data" hereinafter) is inputted from a host computer to a receiving buffer 401 of the ink jet printer 100. Also, data for confirming whether the image data is properly transferred, and data for notifying the operation state of the printer are transferred from the printer to the host computer. The data inputted to the receiving buffer 401 is transferred to a memory section 403 in the form of a RAM and is temporarily stored in it under management of a control section 402 including a CPU. In accordance with a command from the control section 402, the mechanism control section 404 drives a mechanism section 405, e.g., a carriage motor and a line feed motor which serve as power sources for the carriage 101 and the feed roller 109 (see FIG. 3). A sensor/SW (switch) control section 406 sends signals, to the control section 402, from a sensor/SW section 407 including various sensors and switches. A display device control section 408 controls display and indication of a display device section 409, which comprises LEDs, a liquid crystal display, etc. disposed on a display panel, in accordance with commands from the control section 402. A head control section 410 individually controls the heads 30K, 30C, 30M and 30Y in accordance with commands from the control section 402. Other necessary information items, e.g., temperature information representing respective states of the heads, are also transmitted to the control section 402.

A reading control section 411 controls a reading section 412 in accordance with a command from the control section 402, and sends a signal from the reading section 412 to the control section 402.

The recording operation and control of the above-described recording apparatus of the present invention will be described in detail below.

First Embodiment

Figure 6:
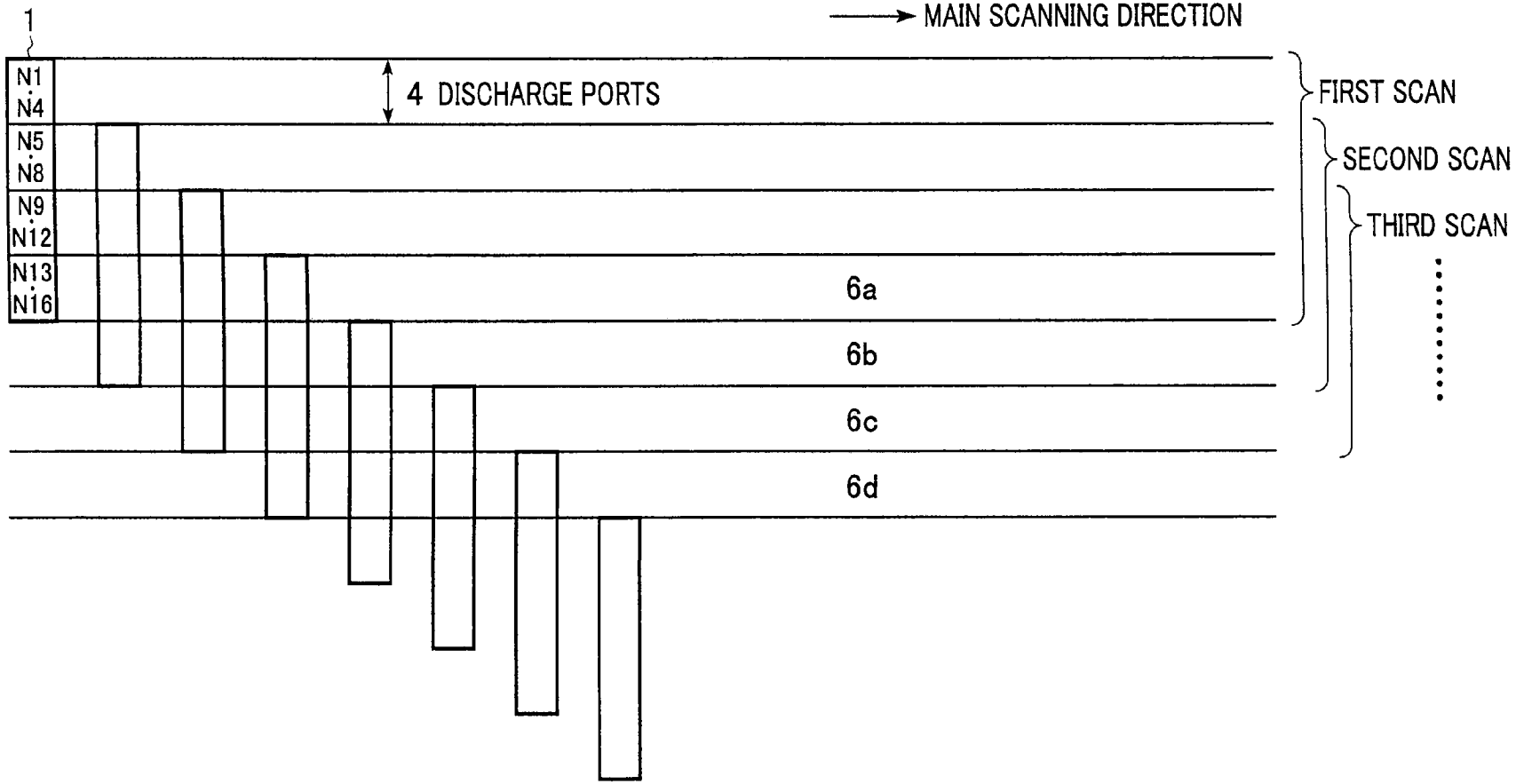
FIG. 6 is a representation for explaining a combination of a feed amount of recording paper and a discharge port used in each scan.

FIG. 6 is a representation for explaining a combination of a feed amount of recording paper and a discharge port used in each scan. In FIG. 6, reference numeral 1 illustrates the recording head. In this example, a total of 16 discharge ports N1 to N16 are divided into four groups, and recording is made by allocating dots to be recorded to four scans.

First to Third Scans

First, in a first scan, only the discharge ports N13 to N16 are employed and ink droplets are discharged through those discharge ports which are allocated in accordance with the input image data. The term "image data" means information representing the position and level of density that dots are to be recorded on the recording paper. A manner of determining from the image data whether the ink droplets are to be discharged in the current scan, i.e., a binary coding process, can be implemented by any one of the suitable known methods, such as simple binary coding, dithering, a method using a mask, or error dispersion method. The input image data (i.e., original data before being subjected to binary-coding) is stored in a memory. Whether the ink is to be discharged from each discharge port of the recording head is controlled in accordance with the binary-coded data and recording dots are formed on the paper. With this first scan, because only the discharge ports N13 to N16 are used for recording, the recording is made on an area, denoted by 6*a*, of the paper corresponding to the array width of those discharge ports.

Then, as shown in FIG. 6, the recording paper is advanced upward through a distance corresponding to four discharge ports (for convenience of illustration, the head is shown as being relatively moved downward), and recording dots are formed by using the discharge ports N9 to N16 in a second scan. As a result, the recording is made on the same area as 6*a*, on which the recording was made in the preceding first scan, by ink droplets discharged through the discharge ports N9 to N12, and the recording is also made on a new area 6*b* of the paper by ink droplets discharged through the discharge ports N13 to N16. After further advancing the recording paper upward through a distance corresponding to four discharge ports, recording dots are similarly formed by using the discharge ports N5 to N16 in a third scan. As a result, the recording is made on the area 6*a* by ink droplets discharged through the discharge ports N5 to N8, on the area 6*b* by ink droplets discharged through the discharge ports N9 to N12, and on a new area 6*c* by ink droplets discharged through the discharge ports N13 to N16. Thus, at this point in time, the area 6*a* is in a state in which, for a recording image to be completed by four scans, the recording has been made by three scans until the third one.

Reading

After the recording made by the third scan, the carriage is scanned backward (i.e., scanned in a direction opposed to that in the recording) while the image recorded by the first, second and third scans (i.e., the image recorded in the area 6*a* by the three scans until the third one) is read by the reading section 21 mounted on the carriage 101.

Creation of Correction Data

Then, the read image is subtracted from the input image data stored in the memory. Prior to the subtraction, if necessary, the read image data is subjected to scaling for tone range adjustment. More specifically, when the input image data is data in the tone range of 0 to 255 (256 levels of gradation) and the reading is performed in the tone range of 0 to 127 (128 levels of gradation), the read image data is doubled to match the tone range.

Then, the data resulting from the subtraction is subjected to binary coding. The binary coding can be implemented by any one of suitable known methods, such as simple binary coding, dithering, a method using a mask, and an error dispersion method.

Then, the recording paper is advanced again upward through a distance corresponding to four discharge ports, and recording dots are formed by using all of the discharge ports N1 to N16 in a fourth scan. At this time, the recording is made on the area 6*a*, in which the recording has been made by the three scans until the third one, in accordance with the above-mentioned correction data by ink droplets discharged through the discharge ports N1 to N4.

By repeating such a sequence of recording steps successively, the whole of an image is recorded. Thus, the image recorded by the first to third scans is read after the recording, and the difference between the read data and the data to be recorded is corrected by the fourth scan. As a result, streaks and density unevenness in a final image are corrected.

In this embodiment, correction based on the image recorded by the fourth scan is not performed. Accordingly, if a large variation resides in the recording made in the fourth scan (i.e., in the recording by ink droplets discharged through the discharge ports N1 to N4), there is a possibility that streaks and density unevenness may occur. However, even if a slight variation resides in the recording made in the fourth scan, a variation after the fourth scan is fairly suppressed and becomes less noticeable because streaks and density unevenness in the image recorded by the first to third scans are corrected by the fourth scan. Stated another way, in this embodiment, the discharge ports used for performing the first to third scans may have discharge variations, and it is suitable to make the recording by using a head in which the discharge ports used for performing the fourth scan have a small discharge variations.

The first embodiment has been described above in connection with the case in which an image is completed by multiple scans, and streaks and density unevenness are reduced by reflecting the result of an image, which has been recorded by other scans than the final one, upon the final scan. The present invention is not limited to such a scheme. In the case in which an image is completed by four scans, for example, an image recorded by the first and second scans until the second one may be recorded, and streaks and density unevenness may be reduced by reflecting the result of reading that image upon image data recorded in the remaining two scans. In such a modification, the recording for reducing streaks and density unevenness is made by multiple scans (two scans in this case) in a dispersed way. Accordingly, even if variations exist in the discharge ports used for performing the recording to correct streaks and density unevenness, those variations are reduced with the multiple scans.

Second Embodiment

Figure 8:
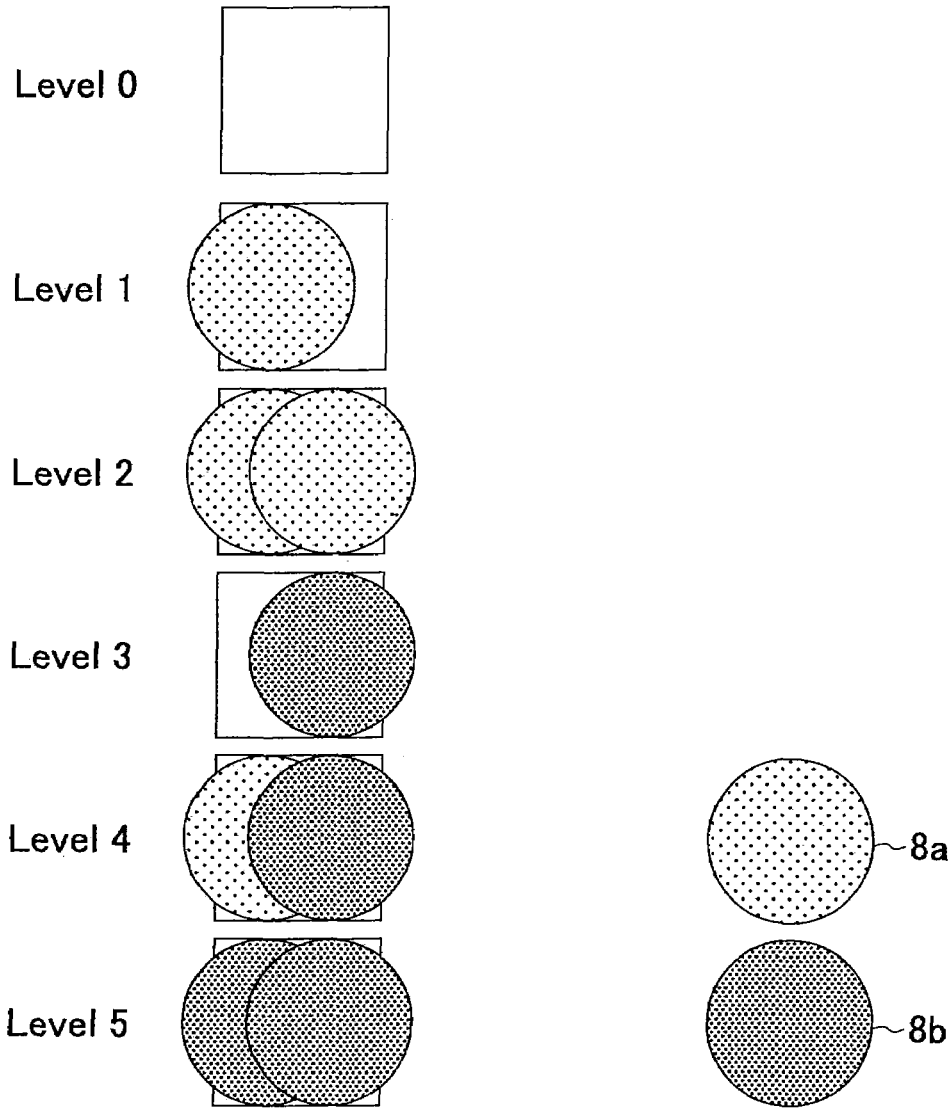
FIG. 8 is an illustration showing an example of recording dots recorded for one pixel in a second embodiment.

In this second embodiment, an image is formed by four scans as in the first embodiment described above, but deep ink droplets are used in the recording made by the first and second scans, light ink droplets are used in the recording made by the third and fourth scans. Further, in this second embodiment, ink droplets are discharged for one pixel in six patterns, i.e., "no ink droplets", "only one light ink droplet", "two light ink droplets", "only one deep ink droplet", "one deep ink droplet and one light ink droplet", and "two deep ink droplets". These six patterns enable the recording to be made at 6 levels of gradation per pixel. FIG. 8 is an illustration for explaining the above six patterns. More specifically, FIG. 8 shows the six patterns at levels of 0 to 5, which are formed by applying a light ink dot 8*a* and a deep ink dot 8*b* to the area of one pixel. Note that positions where the dots are applied in one pixel are not limited to those shown in FIG. 8. For example, the patterns may be formed by selectively applying two dots to diagonal positions in the area of one pixel.

As in the first embodiment, the recording is made in the first to third scans based on the input image data. To perform the recording with the deep ink and the light ink, recording data is allocated for the deep ink and the light ink in accordance with the input image data. Binary data corresponding to the deep ink and the light ink is thereby created for the recording.

In the area where the recording has been completed until the third scan, as in the first embodiment, the recorded image is read by the reading section mounted on the carriage while the carriage is scanned backward. The result of the reading is subtracted from the input image data. Prior to the subtraction, if necessary, the read image data is subjected to scaling for tone range adjustment.

Then, the data resulting from the subtraction is binary-coded and recorded in the fourth scan.

In this second embodiment, the recording in the fourth scan is made by using the light ink. Therefore, even if nozzles for the light ink used in the fourth scan have a discharge variation, a resulting effect is smaller than the effect caused by the recording in the first and second scans with the deep ink. As a result, the recording can be performed at a less difference between an ideal image and an actual image.

Third Embodiment

A third embodiments will be described below in connection with an example in which ink droplets are discharged in plural sizes different from each other and an image is formed by three scans. In the recording operation carried out by the printer according to this third embodiment, an image is formed in the first and second scans by discharging ink droplets each having a large discharge volume, while an image is formed in the third scan by discharging an ink droplet having a small discharge volume.

Further, in this third embodiment, ink droplets are discharged for one pixel in five patterns (at 5 levels of gradation), i.e., "no ink droplets", "one ink droplet having a small discharge volume", "one ink droplet having a large discharge volume", "two ink droplets each having a large discharge volume", and "two ink droplets each having a large discharge volume and one ink droplet having a small discharge volume". Usually, however, the first four patterns (i.e., 4 levels of gradation) are used for the recording, while the last pattern of discharging "two ink droplets each having a large discharge volume and one ink droplet having a small discharge volume" is used for the correction.

Figure 9:
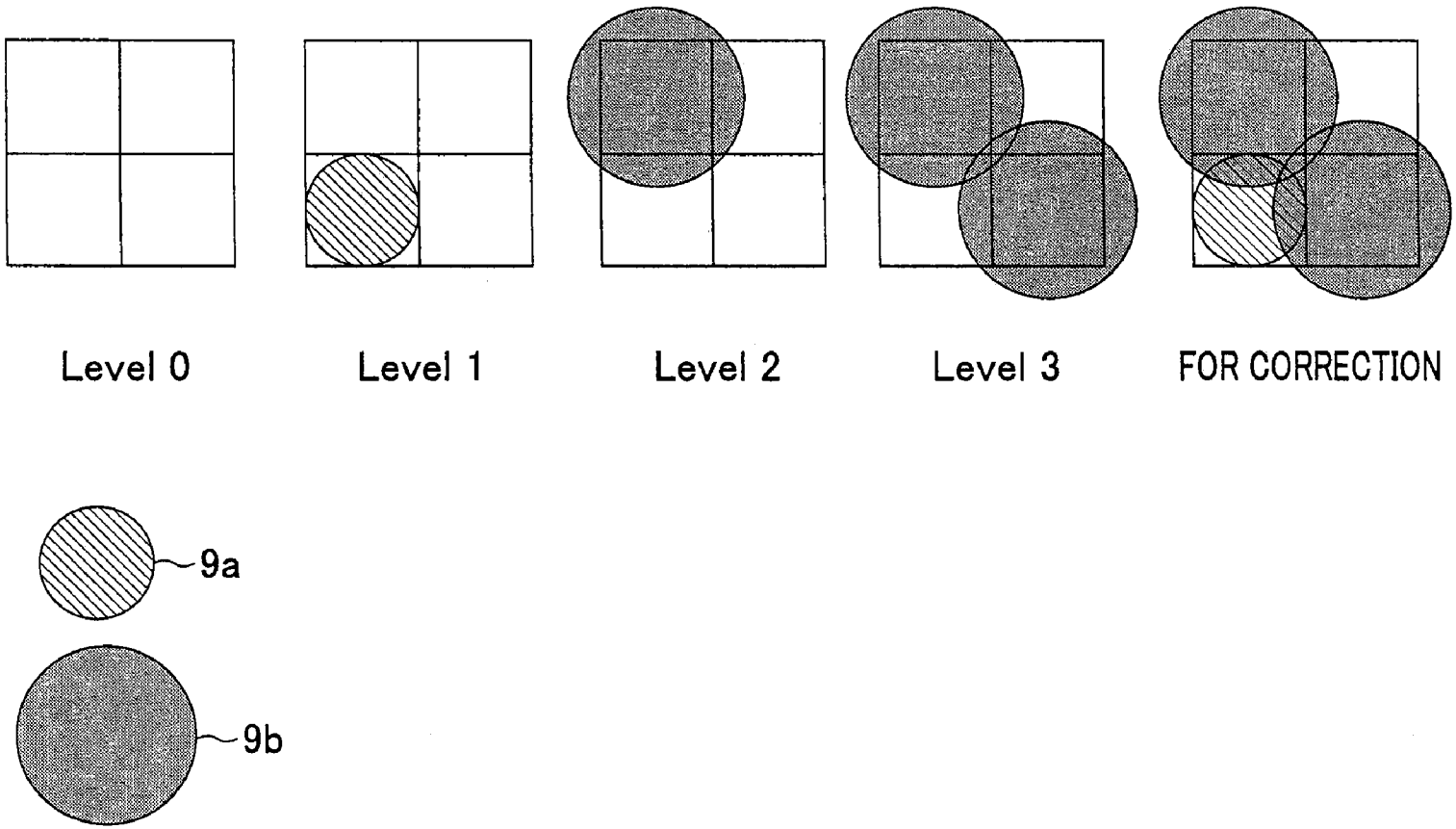
FIG. 9 is an illustration showing an example of recording dots recorded for one pixel in a third embodiment.

FIG. 9 is an illustration for explaining the above five patterns. More specifically, FIG. 9 shows the four patterns at levels 0 to 3 and the remaining one pattern for the correction, which are formed by applying a small dot 9*a* and a large dot 9*b* to the area of one pixel. Note that positions where the dots are applied in one pixel are not limited to those shown in FIG. 9.

The recording is made in the first and second scans based on the input image data. Binary data corresponding to the dot having a large discharge volume (i.e., the large dot) and the dot having a small discharge volume (i.e., the small dot) is created from the input image data. The recording of the large dot and the small dot is controlled in accordance with the created binary data.

In the area where the recording has been completed until the second scan, the image recorded in the first and second scans is read by the reading section mounted on the carriage while the carriage is scanned backward. Based on the result of the reading, data for the third scan is created, or previously created data for the third scan is corrected. In this embodiment, the read density data is subtracted from the input image data. Prior to the subtraction, if necessary, the read image data is subjected to scaling for tone range adjustment. Then, the data resulting from the subtraction is binary-coded and recorded in the third scan.

Eventually, in the third scan, the recording is performed in two cases given below. In the first case, only the ink droplet having a small discharge volume is recorded. In the second case, the ink droplet having a small discharge volume is additionally recorded for the correction when, as a result of recording one or two ink droplets each having a large discharge volume in the first and second scans, the resulting discharge volume is not sufficient and the recording density of the input image data is not yet reached.

With this third embodiment, even if the discharge volumes of nozzles used for the recording in the first and second scans are not sufficient, such a deficiency can be corrected by recording the ink droplet having a small discharge volume in the third scan.

According to the first to third embodiments described above, in the so-called multi-scan recording operation in which an image is completed by multiple scans of a recording head, a recorded image is read before the completion of the image, practically before the last scan to complete the image, and recording data used for the last scan to complete the image is corrected based on the result of the reading so that streaks and density unevenness in the completed image are reduced. The term "last scan" used herein means not the last scan to complete an image of one page, but the last scan to complete an image that is to be recorded in each area where the image is completed by the multiple scans. With such a recording operation, the result of reading the image recorded before the last scan to detect streaks and density unevenness is reflected upon the data for the last scan. The image recording is thereby realized in which the last scan serves to not only complete the image, but also to reduce the streaks and the density unevenness.

Fourth Embodiment

The present invention is also effectively applied to a printer of the so-called full multi-head having discharge ports arranged over the width of recording paper. The term "full multi-head" used herein means a head in which nozzles are arranged corresponding to the length of a recording medium in the width direction thereof, and the recording can be made on an overall area of the recording medium by scanning the head once over the recording medium. The scan of the head over the recording medium can be performed in a relative way. In general, the recording is performed such that the full multi-head is fixed in the printer at a particular position and the recording medium is fed relative to the full multi-head.

Figure 7:
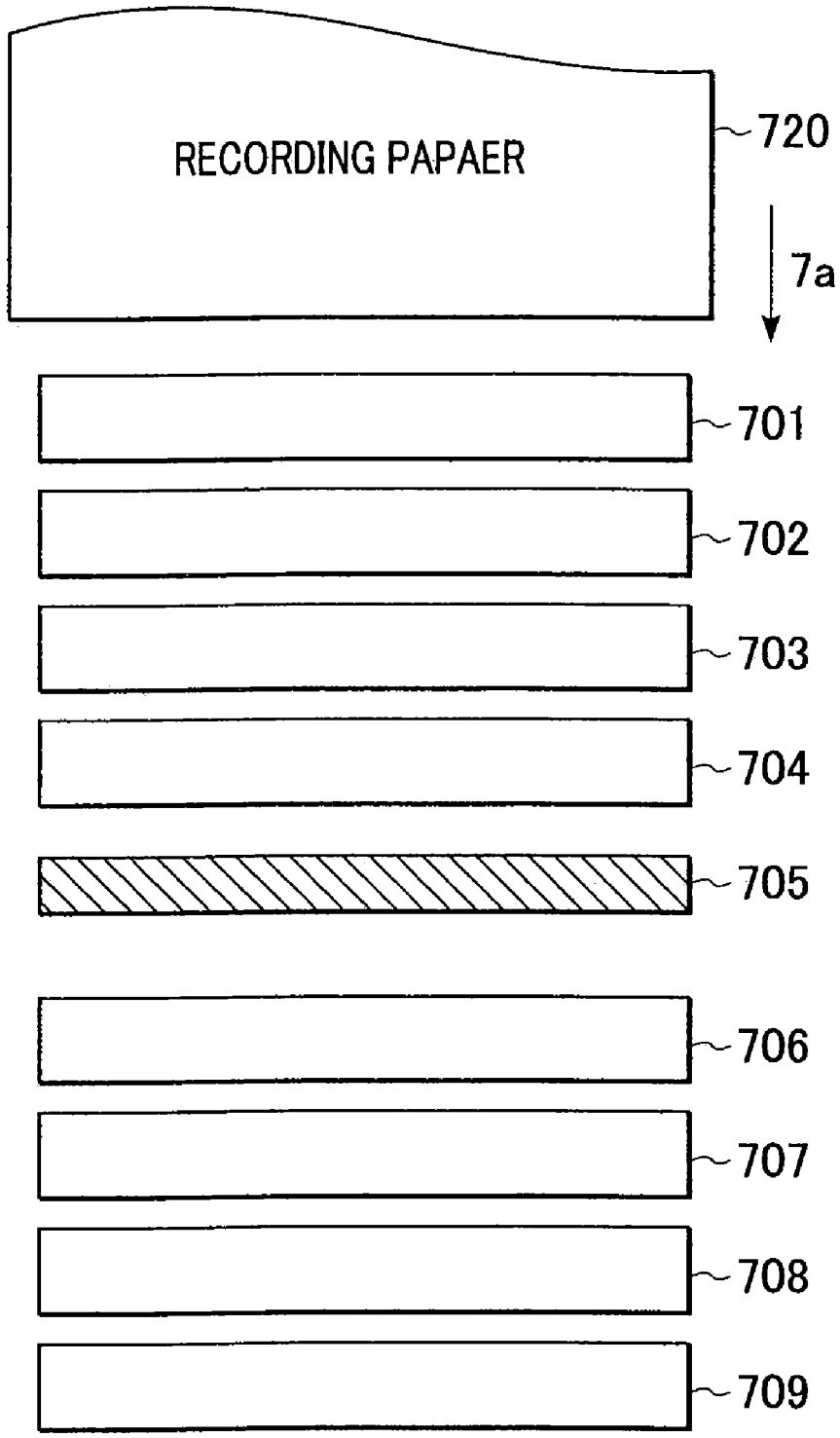
FIG. 7 is a perspective view showing a head arrangement as one example of construction of a full multi-head printer to which the present invention can be applied.

FIG. 7 schematically shows a head arrangement. Numerals 701 to 704 denote respectively full multiple heads of YMCK (called here a first multi-head), and 705 denote an optical reading device. Numerals 706 to 709 denote respectively other full multiple heads of YMCK (called here a second multi-head). Recording paper 720 is fed in the direction of arrow 7*a* relative to the full multiple heads. During the feed of the recording paper 720, inks are discharged through the respective heads for recording. The optical reading device (reading means) 705 is disposed downstream of the first multi-head and upstream of the second multi-head in the feed direction of the recording paper so that it is able to read an image recorded by the first multi-head.

The feed direction 7*a* of the recording paper is defined as directing from above to below on the drawing sheet (it is here assumed that the feed direction is the main scanning direction). The recording is first made by the first multi-head (701 to 704). Then, the image recorded by the first multi-head is read by the optical reading device 705, and the result of the reading is subtracted from the input image data. Prior to the subtraction, if necessary, the read image data is subjected to scaling for tone range adjustment.

Then, the data resulting from the subtraction is binary-coded and recorded by the second multi-head.

With this fourth embodiment, even if there is a failure in the ink discharge from the first multi-head, the failure can be corrected to some extent with the recording made by the second multi-head.

In this fourth embodiment, allocation of the image data to the first multi-head (701 to 704) on the upstream side and the second multi-head (706 to 709) on the downstream side is not limited to a fifty-to-fifty ratio. For example, the image data may allocated at a larger ratio to the first multi-head on the upstream side and at a smaller ratio to the second multi-head on the downstream side. In such a case, the second multi-head serves mainly to perform the recording to reduce streaks and density unevenness in the image recorded by the first multi-head. Stated another way, because the recording based on the image data is performed by the second multi-head at a smaller ratio, it is possible to suppress streaks and density unevenness caused by recording characteristics of the first multi-head.

While this fourth embodiment has been described in connection with the case employing two heads per color, the present invention can more preferably be applied to full multi-head printers having 3, 4 or more heads per color because the correction effect is increased as the number of heads per color increases.

While the first to third embodiments are adapted for the recording system for completing an image by multiple scans, the fourth embodiment is adapted for the full multi-head recording system for completing an image by one feed (scan) of the recording medium and is intended to reduce streaks and density unevenness attributable to density and discharge characteristics of the recording heads.

Thus, the fourth embodiment is featured in that two sets of recording heads are disposed in spaced relation in the feed direction of the recording medium and, after recording an image by one set of recording heads on the upstream side, the recorded image is read. Then, based on the result of the reading, the image data to be recorded by the other set of recording heads on the downstream side is corrected, whereby streaks and density unevenness in a finally recorded image are reduced.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus including a recording head having a recording width corresponding to a recording area of a recording medium in a width direction thereof, the recording head recording an image while the recording medium is fed, the apparatus comprising:

a first recording head and at least a second recording head disposed in spaced relation in a feed direction of the recording medium;

reading means disposed at a position downstream of the first recording head and upstream of the last recording head in the feed direction of the recording medium to be able to read an image recorded by one or more recording heads upstream of the reading means; and correcting means for correcting, based on a result of the reading means, data used for recording made by the downstream recording head, wherein the image to be recorded is completed by superimposing an image onto the image recorded by the first recording head, by at least the second recording head.

2. A recording apparatus according to claim 1, wherein the one or more recording heads downstream of the reading means forms an image whose visibility is lower than visibility of an image formed by the one or more recording head upstream of the reading means.

3. A recording apparatus according to claim 2, wherein the one or more recording heads downstream of the reading means record with ink having a lower concentration than the ink used by the one or more recording heads upstream of the reading means.

4. A recording apparatus according to claim 2, wherein the one or more recording heads downstream of the reading means record with ink droplets having a smaller size than the ink droplets used by the one or more recording heads upstream of the reading means.

5. A recording apparatus according to claim 1, wherein the correcting means subtracts the image data read by the reading means from input image data to obtain the data used for recording made by the one or more downstream recording heads.

6. A recording apparatus according to claim 1, wherein the image data read by the reading means is subjected to scaling for tone range adjustment prior to being used by the correcting means.

7. A recording apparatus according to claim 1, wherein the correcting means produces binary-coded data that represents the ink that is discharged from each discharge port of the one or more downstream recording heads, such binary-coded data is produced by simple binary-coding, dithering, a method using a mask, or an error dispersion method.

8. A recording method comprising:

a first recording step for recording an image to be recorded to a step before completion;

a reading step for reading the image recorded by the first recording step;

a correcting step for producing data to correct the image recorded in the first recording step based on the result of the reading step; and a second recording step for recording the data produced in the correcting step on the image recorded in the first recording step for completing the image to be recorded by recording an image superimposed onto the image recorded in the first recording step.

9. A recording method according to claim 8, wherein the second recording step forms an image with less visibility than visibility of an image formed by the first recording step.

10. A recording method according to claim 9, wherein the second recording step is performed with ink having a lower concentration than the ink used in the first recording step.

11. A recording method according to claim 9, wherein the second recording step is performed with ink droplets having a smaller size than the ink droplets used in the first recording step.

* * * * *

UNITED STATES PATENT AND TRADEMARK OFFICE

CERTIFICATE OF CORRECTION

PATENT NO. : 7,380,901 B2
APPLICATION NO. : 11/533950
DATED : June 3, 2008
INVENTOR(S) : Makoto Shioya It is certified that error appears in the above-identified patent and that said Letters Patent is hereby corrected as shown below:

COLUMN 3:

Line 53, “recoding” should read --recording--.

COLUMN 4:

Line 37, “sans” should read --scans--.

COLUMN 12:

Line 14 Claim 2, “forms” should read --form--.

Signed and Sealed this

Seventeenth Day of February, 2009

John Doll

JOHN DOLL
*Acting Director of the United States Patent and Trademark Office*